US010002516B1

(12) United States Patent
Kahng

(10) Patent No.: US 10,002,516 B1
(45) Date of Patent: Jun. 19, 2018

(54) UMBRELLA WITH WIRELESS TETHER

(71) Applicant: David Kahng, New York, NY (US)

(72) Inventor: David Kahng, New York, NY (US)

( * ) Notice: Subject to any disclaimer, the term of this patent is extended or adjusted under 35 U.S.C. 154(b) by 29 days.

(21) Appl. No.: 15/379,737

(22) Filed: Dec. 15, 2016

(51) Int. Cl.

| | |
|---|---|
| ***G08B 13/14*** | (2006.01) |
| ***G08B 21/24*** | (2006.01) |
| ***A45B 25/02*** | (2006.01) |
| *A45B 25/00* | (2006.01) |

(52) U.S. Cl.
CPC ..... *G08B 21/24* (2013.01); *A45B 25/02* (2013.01); *A45B 2025/003* (2013.01); *A45B 2200/1018* (2013.01); *A45B 2200/1081* (2013.01)

(58) Field of Classification Search
CPC . G08B 21/24; A45B 25/02; A45B 2200/1018; A45B 2025/003; A45B 2200/1081
USPC ..... 340/568.1, 5.23, 522.1, 539.13, 539.23, 340/691.3, 692, 10.33, 870.07; 135/16, 135/23, 33.2; 705/3, 37; 700/275, 276
See application file for complete search history.

(56) References Cited

U.S. PATENT DOCUMENTS

| | | | | |
|---|---|---|---|---|
| 4,887,543 | A | 12/1989 | Rockhill | |
| 6,836,212 | B2 | 12/2004 | Sawinski | |
| 7,323,983 | B2 | 1/2008 | Bergman | |
| 2006/0267761 | A1* | 11/2006 | Bergman | G08B 21/24 340/539.23 |
| 2010/0328924 | A1* | 12/2010 | Nissen | A45B 3/04 362/84 |
| 2013/0027912 | A1* | 1/2013 | Liao | A45B 3/02 362/102 |
| 2014/0026475 | A1* | 1/2014 | Centeno | A01G 13/02 47/29.5 |
| 2014/0145845 | A1* | 5/2014 | Sattari | G08B 21/22 340/539.13 |
| 2017/0061171 | A1* | 3/2017 | Lombardi | G06K 7/10019 |

OTHER PUBLICATIONS

Kickstarter 1 (Mar. 2015): https://www.kickstarter.com/projects/896798832/davek-alert-umbrella-never-lose-your-umbrella-agai?ref=user_menu.
Kickstarter 2 (Apr. 2016): https://www.kickstarter.com/projects/1540069583/davek-uniquely-strong-umbrellas-with-loss-alert/description.

* cited by examiner

*Primary Examiner* — Dhaval Patel
(74) *Attorney, Agent, or Firm* — Epstein Drangel LLP; Robert L. Epstein

(57) ABSTRACT

The umbrella cooperates with a software application adapted to run on a mobile communications device wirelessly synced to the umbrella. The umbrella includes a communications module adapted to transmit a wireless beacon signal in response to the detection of movement of the umbrella. The software application detects the beacon signal when the smartphone is within range of the umbrella and generates an alert when the beacon signal is no longer being received, indicating that the smartphone is no longer within range and the umbrella has been forgotten. In one embodiment, the GPS application on the smartphone is cause to generate a location update signal in response to detection of the beacon signal such that the software application can run continuously in the background on the smartphone to ensure timely range entry and exit notifications.

10 Claims, 9 Drawing Sheets

UMBRELLA WITH WIRELESS TETHER

BACKGROUND OF THE INVENTION

1. Field of the Invention

The present invention relates to umbrellas and more particularly, to an umbrella which is wirelessly synced to a mobile communications device such as a smartphone which runs a software application capable of detecting when the umbrella and smartphone are more than a given distance apart and causing an alert to be sent to the smartphone user that the umbrella is out of range.

2. Description of Prior Art Including Information Disclosed Under 37 CFR 1.97 and 1.98

Thousands of umbrellas are lost every year. Many are left on public transportation vehicles such as trains, taxi cabs and buses. Others are left in restaurants, theaters, sports stadiums and the like.

Over the years attempts have been made to use technology to reduce the number of umbrellas that end up in lost and found depositories. However, none of those attempts have resulted commercially acceptable solutions which have substantially decreased the number of lost umbrellas.

For example, U.S. Pat. No. 4,887,543 entitled "Unforgettable Umbrella Method" teaches a method and a device to aid in recollecting a user to retrieve an umbrella left in a building. The device includes an eye device on the handle of the umbrella with an identification plastic panel attached with a spring clip through the eye. The identification device is unclipped from the umbrella when the umbrella is left behind upon entrance to the building and is immediately clipped onto a key ring on which automobile or residence door keys are clipped. If the umbrella is forgotten, the next use of the key ring will automatically remind the user that the umbrella has been left behind. After the umbrella has been retrieved, the identification device is unclipped from the key ring and reattached to the eye device on the umbrella for the next use.

U.S. Pat. No. 6,836,212 entitled "Method and Apparatus for Reducing the Likelihood of Losing a Portable Electronic Device" teaches a loss prevention system which employs a method and apparatus for reducing the likelihood of losing a portable electronic device that has been inadvertently removed from its retaining device. The loss prevention system includes the electronic device and its retaining device. The electronic device includes a proximity detector that operates to detect the absence or removal of the device from the retaining device. The electronic device also includes a lost device detection circuit that determines whether the removal was intentional and, if unintentional, alerts the user of the removal. By so alerting the user, the loss prevention system provides rapid feedback to the user after the user's electronic device has inadvertently fallen out of its retaining device, thereby enabling the user to quickly retrieve the device before it gets damaged or taken by someone else.

U.S. Pat. No. 7,323,983 entitled "Device for Alerting When Umbrella is Left Behind" teaches an umbrella with a device built into the handle of the umbrella. When detached from the handle, the device serves as a receiver of a pulsating RF signal, or other electronic communication, sent from the handle of the umbrella. There is a transmitter located in the handle of the umbrella and a receiver located in the detachable device. When the detachable device is separated from the umbrella handle, the device is activated and when separated by more than a preset distance, the receiver senses the diminished strength of the communication signal and the device automatically goes into "alert" mode. In "alert" mode, the device vibrates and/or beeps until the device is brought back within the range of the preset distance from the umbrella handle.

Those patented devices have not proved commercially successful for a variety of reasons. One of the most important reasons is that the each of the patent inventions requires a separate electronic component be attached to and removed from the umbrella which requires a specially configured umbrella handle. The separate component can be easily lost and is itself expensive to manufacture. Further, separating the component requires that the user to plan ahead to use the invention and to take certain actions that the user would not normally do. In addition, each of the components requires its own power and therefore power consumption is an issue.

It would be advantageous to have a system which alerts the user that the umbrella is out of range that does not require a detachable component and an umbrella specially designed to mate with a detachable component. It would be desirable to have a system which does not require additional action such as the handling of a detachable component on the part of the user to utilize. In addition, it is important that the beacon transmitting circuit in the umbrella conserve energy such that it is able to operate over extended periods of time without frequent battery replacement and that the software application be capable of running in the background on the smartphone to allow other applications to run while the distance between the umbrella and smartphone is monitored.

BRIEF SUMMARY OF THE INVENTION

It is a prime object of the present invention to provide an umbrella with a wireless tether.

It is a further object of the present invention to provide an umbrella with a wireless tether in which an integrated circuit mounted within the handle of the umbrella periodically transmits a beacon signal in response to detecting movement of the umbrella.

It is a further object of the present invention to provide an umbrella with a wireless tether in which a software application running on a smartphone receives the signal from the circuit and determines when the magnitude of the received beacon signal fall below a set threshold level indicating that the umbrella and smartphone separated by a given distance.

It is a further object of the present invention to provide an umbrella with a wireless tether in which the circuit normally operates in a low energy consumption mode and changes to a high energy consumption mode when movement of the umbrella is detected.

It is a further object of the present invention to provide an umbrella with a wireless tether in which the software application alerts the smartphone user when the umbrella is out of range from the smartphone.

It is a further object of the present invention to provide an umbrella with a wireless tether which senses that the umbrella is out of range of the smartphone while the software application operates in the background.

It is a further object of the present invention to provide an umbrella with a wireless tether in which, in one preferred embodiment, periodically causes the GPS application on the smartphone to provide an output signal which allows the software application of the present invention to run in the background.

In accordance with one aspect of the present invention, an umbrella and a software application adapted to run on a mobile communications device such as a smartphone wirelessly synced to the umbrella are provided. The umbrella includes an integrated circuit associated with the umbrella. The integrated circuit has a communications module adapted to transmit a wireless beacon signal. That module has a timing circuit and normally operating in an inactive mode. The circuit also includes an accelerometer adapted to detect movement of the umbrella and to generate an activation signal to the communications module when movement of the umbrella is detected causing the module to operate in an active mode and periodically transmit the beacon signal for a time period measured by the timing circuit. The software application is capable of detecting the beacon signal transmitted from the module when the umbrella and the smartphone are within a given distance from each other. It generates an alert to the user of the smartphone when the beacon signal is no longer being received, indicating that the umbrella and the smartphone are no longer within the given distance from each other.

The integrated circuit also supports a battery connected to power the integrated circuit and a voltage monitor for measuring the voltage output of the battery. The voltage monitor periodically measures the voltage output of the battery and causes the module to include a low battery notification as part of the wireless beacon signal if the measured voltage output of the battery is below a given level.

The umbrella has a handle. The handle has a recess within which the integrated circuit is situated. The umbrella also has a removable cap within which the integrated circuit is retained and a part adapted to receive the cap secured within the handle recess.

The umbrella has a rib. A compartment adapted to retain the integrated circuit may be attached to the umbrella rib.

The software application generates a "connected" notification upon receipt of the beacon signal and continues to do so for as long as the beacon signal is detected. It generates a "not connected" notification in the absence of a beacon signal.

The software application runs on a smartphone comprising a GPS application capable of generating a location update signal and causes the GPS to generate the location update signal when the beacon signal is received. The software application has a location update timer which stops the GPS from generating the location update signal a set time after said beacon signal is no longer detected.

In accordance with another aspect of the present invention, an umbrella is provided for use with a software application adapted to run on a mobile communications device such as a smartphone wirelessly synced to the umbrella, The umbrella has a handle within which an integrated circuit is situated. The integrated circuit includes a communications module adapted to transmit a wireless beacon signal, an accelerometer adapted to detect movement of the umbrella and to generate an activation signal to the communications module when movement of the umbrella is detected, causing the module to periodically transmit the beacon signal. The umbrella has a handle with a recess defined in part by a bottom wall, a cap adapted to retain the integrated circuit and a part adapted to receive the cap. Means are provided for securing the part to the recess bottom wall. Means are also provided for securing the cap to the part.

The cap securing means takes the form of a bayonet-type connecting mechanism.

The part securing means includes an internally threaded bore in the handle and an externally threaded shaft extending from the part.

The integrated circuit has a LED. The cap includes an opening aligned with the LED such that the LED can be observed with the cap mounted on the handle.

The integrated circuit includes spaced plates defining a recess within which a battery may be retained.

The communications module may be any commercially available module capable of transmitting the beacon signal which can operate in a low energy consumption mode and in a high energy consumption mode. The module operates in a low energy consumption mode until the activation signal is generated. The module operates in a high energy consumption mode for a given time period after the activation signal is generated. For purposes of this specification, the term "module" is intended to include any component or set of electrical circuits including a microprocessor, I/O controller, a memory, a clock, a power manager, and an antenna provided as a unit or individually which are capable of being programmed or configured to transmit a beacon signal of the type discussed herein.

The integrated circuit includes a battery output voltage monitor.

In accordance with another aspect of the present invention, a software application designed to run on a mobile communications device such as a smartphone is provided. The software application is capable of detecting a beacon signal transmitted from a communications module associated with an umbrella, when said umbrella and the smartphone are within a given distance from each other, and for generating an alert to the user of the smartphone when the beacon signal is no longer being received, indicating that the umbrella and the smartphone are no longer within the given distance. The software application generates an entry notification in response to the detection of the beacon signal indicating that the smartphone is within range of the umbrella and generates an exit notification in response to the loss of the beacon signal, indicating that the smartphone is outside the range of the umbrella.

The smartphone includes a GPS application capable of generating a location update signal. The software application causes the GPS application to generate a location update signal in response to the entry notification.

The software application includes a location update timer which is set upon generation of the exit notification. It turns off the software application when the location update timer expires. The location update timer is reset in response to the detection of a beacon signal.

BRIEF DESCRIPTION OF THE SEVERAL VIEWS OF DRAWINGS

To these and to such other objects that may hereinafter appears, the present invention relates to an umbrella with wireless tether as described in detail in the following specification and recited in the annexed claims, taken together with the accompanying drawings, in which like numerals refer to like parts and in which:

Figure 8:
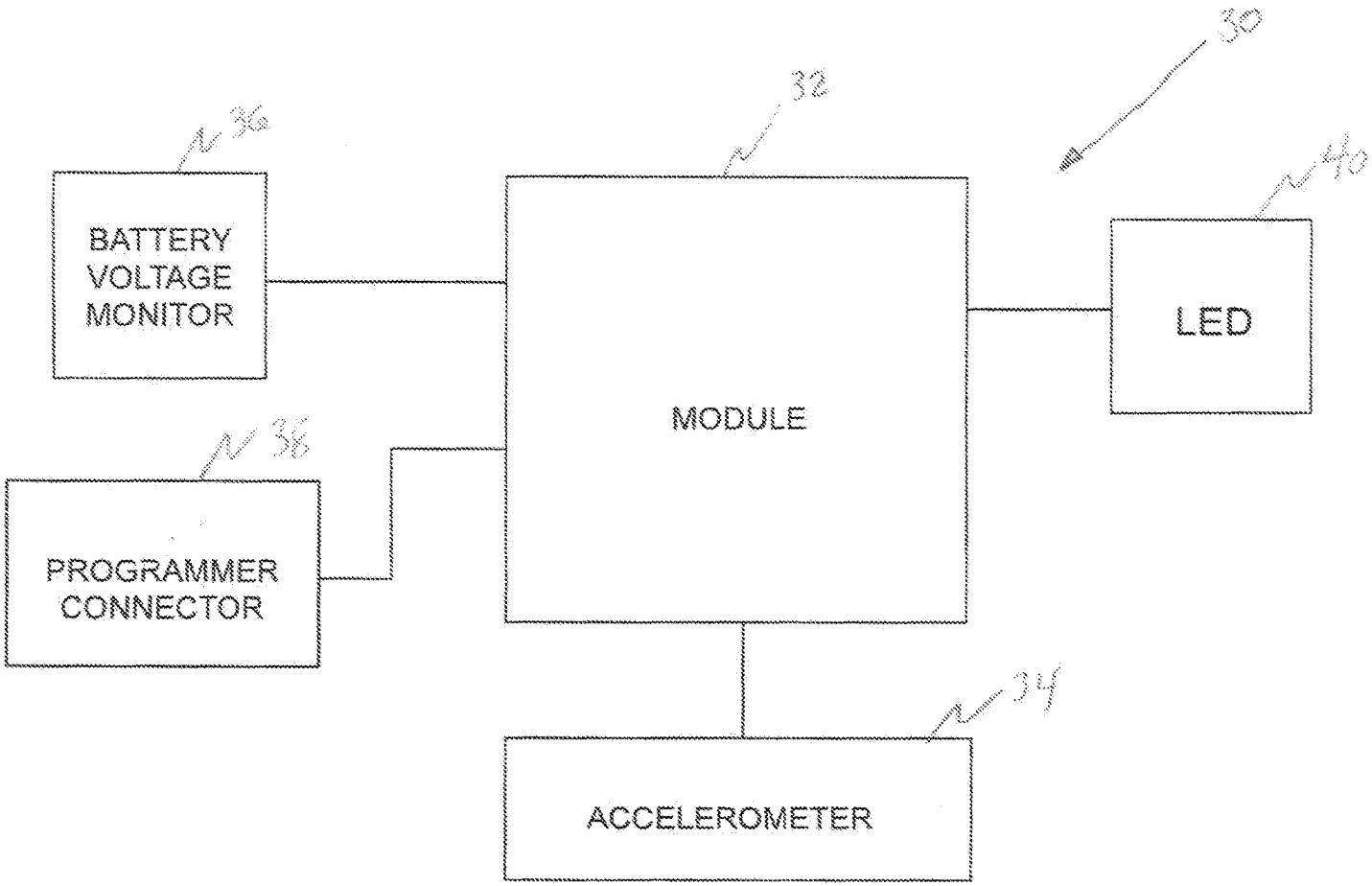
Figure 9:
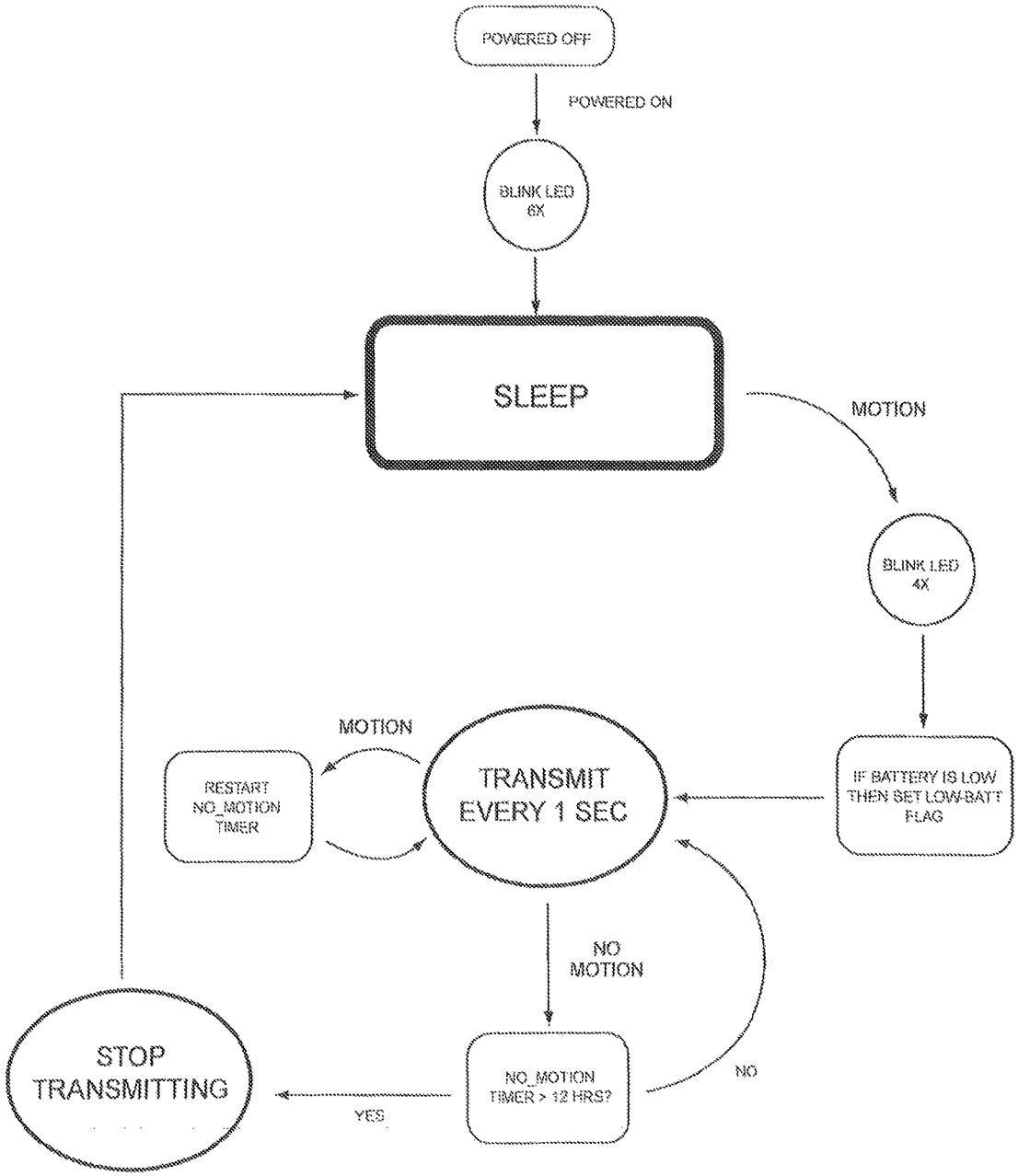
Figure 10:
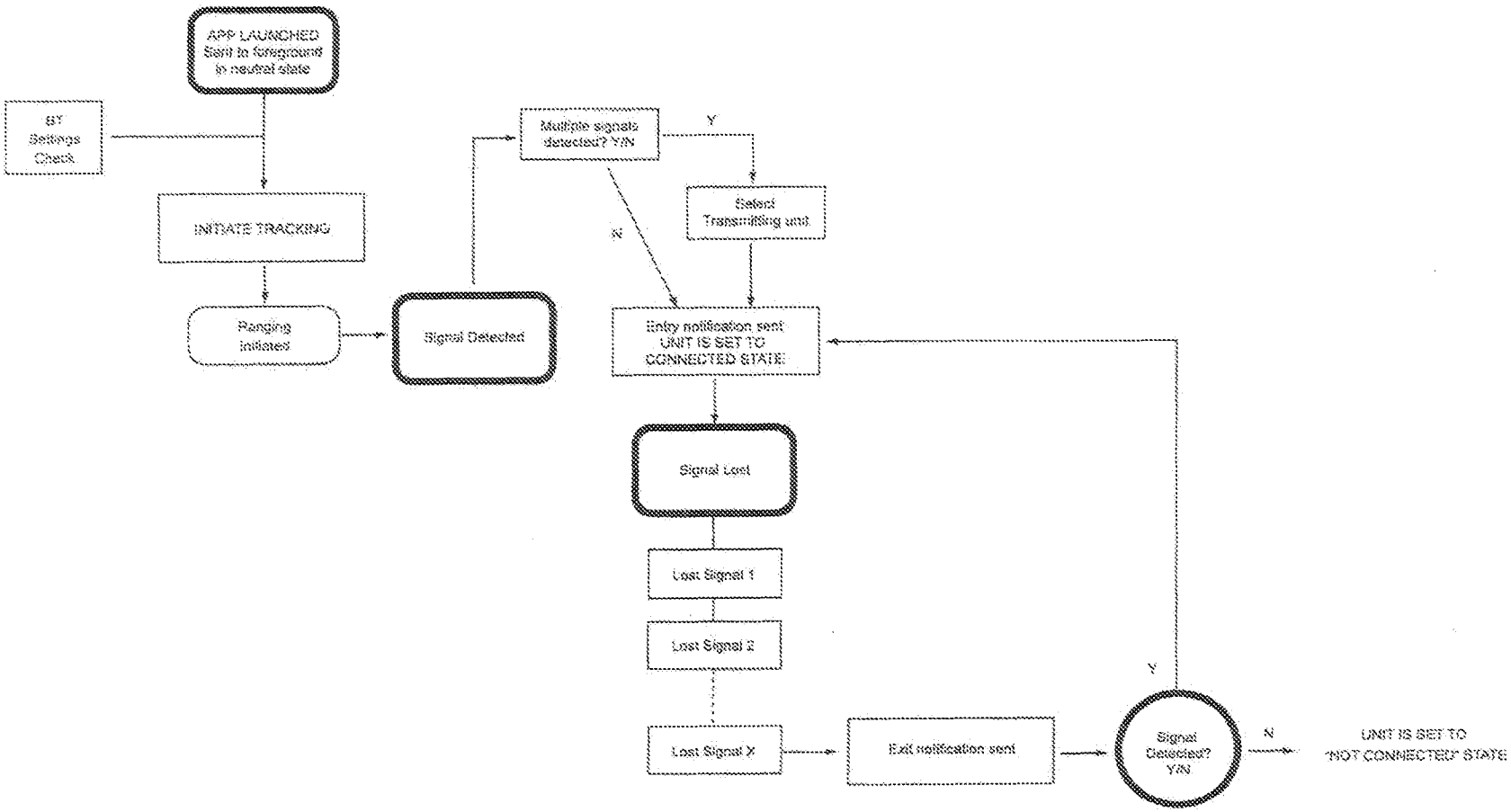
Figure 11:
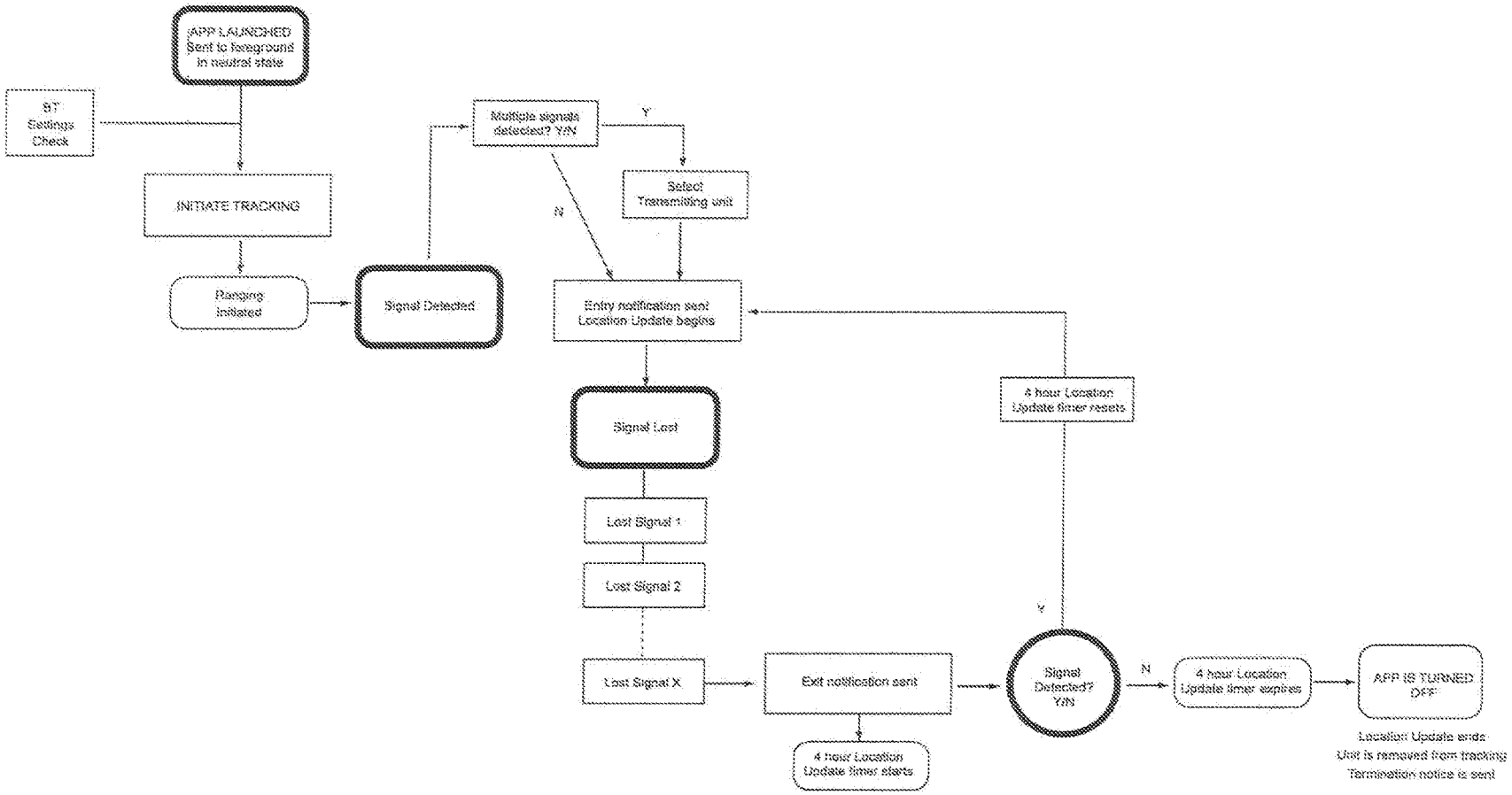
Figure 12:
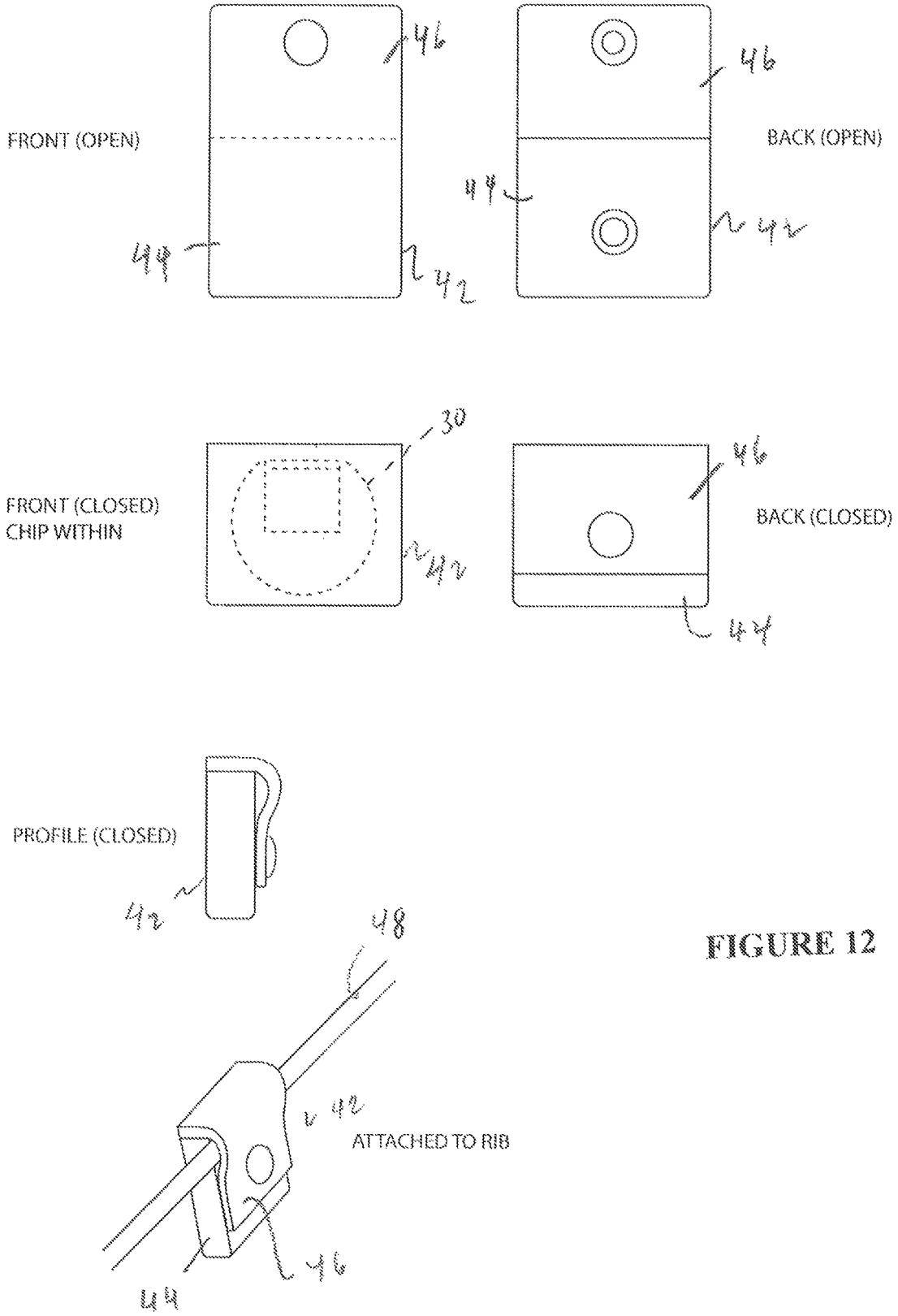

FIG. 8 of the block diagram of the components of the integrated circuit board;

FIG. 8 is a flow chart illustrating the function of the integrated circuit board;

FIG. 9 is a schematic diagram of the integrated circuit;

FIG. 10 is a flow chart of a first preferred embodiment of the software application of the present invention;

FIG. 11 is a flow chart of a second preferred embodiment of the software application of the present invention; and FIG. 12 includes a series of view of a compartment which can retain an integrated circuit and be attached to the rib of an umbrella.

DETAILED DESCRIPTION OF THE INVENTION

The invention relates to an umbrella which interacts with a software application, such as an iOS/Android app, running on a communications device such as smartphone that will alert umbrella owners if they accidentally leave their umbrellas behind. As explained in detail below, the umbrella houses a small integrated circuit including a communications module situated within a cavity in the umbrella handle. The circuit will communicate with the software application installed into the owner's mobile phone, eliminating the necessity for a separate component associated with the umbrella.

The integrated circuit in the umbrella periodically emits a beacon proximity signal, for example, every 100 ms to 5 seconds. The proximity signal will allow the software application running on the smartphone to determine whether the smartphone is in close/far proximity of the umbrella.

The integrated circuit in the umbrella includes an accelerometer. The accelerometer detects movement of the umbrella indicating that the umbrella is or has been moved. The communications module is connected to the accelerator output such that beacon signal reflects that the umbrella is or has been moved. Once synced, the umbrella will notify the owner's smartphone, if the umbrella is out of range, indicating that the umbrella has been left behind.

A replaceable battery is provided in the umbrella handle to power the integrated circuit. Since the circuit in the umbrella will operate for hours at a time, energy consumption is an issue. For that reason, the integrated circuit may be programmed to operate in a low energy consumption mode, or to turn off, whenever possible.

Most other items that are prone to loss (i.e. wallets, keys, smartphones) do not experience long periods of non-motion (they are typically used daily or at least regularly, and thus in regular motion. So, implementing a low energy consumption mode or turning them off completely while not in motion would not be useful, since the period that they are not in motion is not long. However, that is not true of umbrellas because only a fraction of an umbrella's life is actually in use (when it rains). The vast majority of the time, an umbrella is typically in storage.

Further, the umbrella is typically in transit when in use (unlike a TV remote, for example) and most umbrella losses are due to leaving the umbrella behind (as opposed to forgetting where it was put).

These characteristics allow use of an apparatus which minimizes the energy consumption of the battery which powers the integrated circuit such that the battery does not have to be replaced frequently. In the present invention, the communications module is normally operated in the low energy consumption mode or "off" and changes to the high energy consumption mode or "on" only when movement of the umbrella is detected by the accelerometer.

The principle purpose of the present invention is not for finding a lost umbrella. The present invention is intended to prevent the loss of the umbrella in the first place by alerting the user that the umbrella is out of range of the smartphone such that the user knows to immediately retrieve the umbrella. Thus, the communications module does not always need to be transmitting the beacon signal—it only needs to be transmitting on during use, when movement has been sensed. Other object finding systems require that the beacon signal be transmitted continuously, resulting in much higher power consumption requirements.

An accelerometer can be used to detect motion, acceleration, vibration, speed, orientation. Most commonly, accelerometers are used to detect orientation, for example, for a smartphone to adjust the screen from portrait (vertical) to landscape (horizontal) mode. Many game apps use the accelerometer to detect phone tilt for car racing game apps, or pedometers use the sensor to detect the number of steps. However, it is not believed that an accelerometer has ever been used in an umbrella to control the energy consumption of a communications module in the manner of the present invention.

Figure 1:
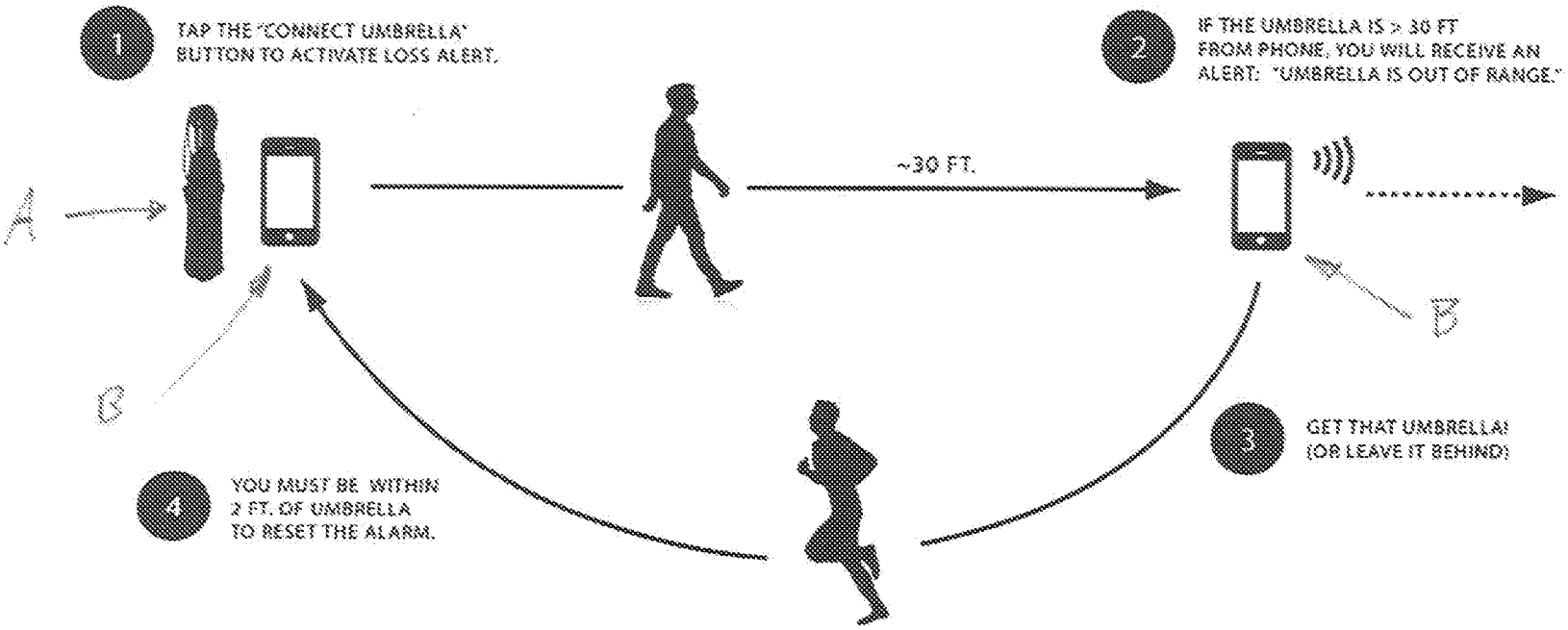
FIG. 1 is a graphic representation illustrating how the umbrella of the present invention functions with a mobile communications device to alert a user that the umbrella is out of range.
Figure 2:
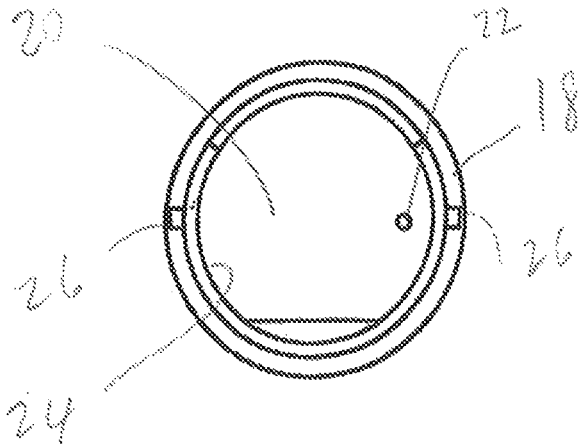
FIG. 2 is a plan view of inside of the bottom of the umbrella cap.
Figure 3:
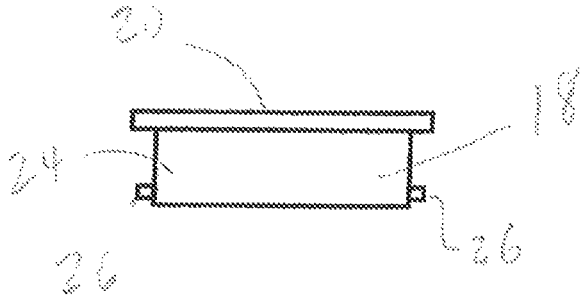
FIG. 3 is a side elevation view of the umbrella cap.
Figure 4:
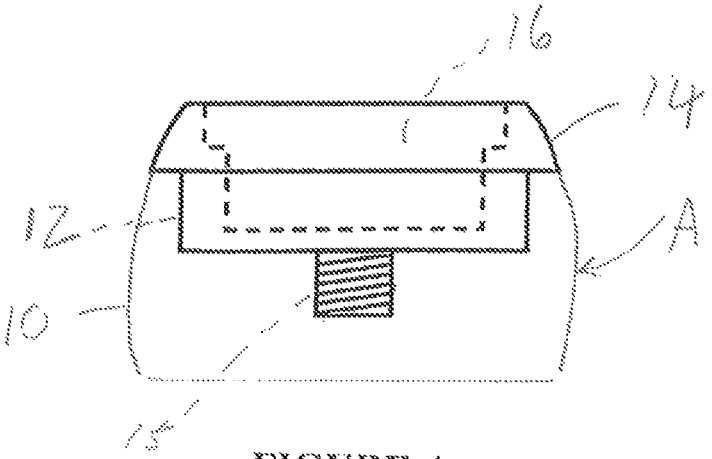
FIG. 4 is a side elevation view of the cap receiving part without the cap in place, mounted on the umbrella.
Figure 5:
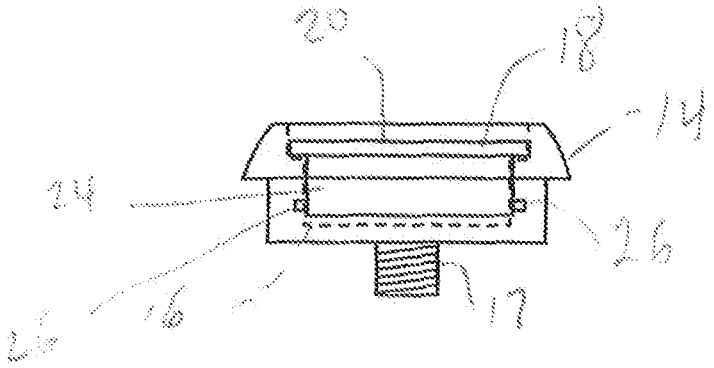
FIG. 5 is a cross-sectional view of the cap receiving part of the umbrella with the cap in place.

As illustrated in FIG. 1, after the umbrella, generally designated A, is wirelessly synced to the owner's mobile communications device such as a smartphone, generally designated B, and the software application in the smartphone is activated, the smartphone will display an alert such as "UMBRELLA IS OUT OF RANGE" if the smartphone and umbrella are separated by a preset distance or range, for example, 30 feet. That alert will remind the user to retrieve the umbrella if it has been inadvertently left behind. To reset the alarm, the user must return to a location within a short distance from the umbrella, for example 2 feet. Alternatively, if the umbrella has been left on purpose, the user will receive the range exit notification and allow the umbrella to remain thereafter out of range.

FIG. 2-7 illustrate the handle 10 of the umbrella A and the manner in which the integrated circuit is mounted in the handle. The end of handle A is provided with a recess 12 into which a hollow part 14, shown in FIGS. 4 through 7, is received. In particular, the floor of recess 12 has an internally threaded central bore adapted to receive the externally threaded shaft 17 which extends downwardly from the bottom of part 14. During the manufacturing process, part 14 is screwed into the handle recess 12 such that shaft 17 is received in bore 15 and is permanently affixed to the handle by adhesive or the like.

Part 14 defines a recess 16 into with which a removable cap 18 is received. Cap 18 is shown from underneath in FIG. 2 and from the side in FIG. 3. Cap 18 includes top 20 with a small opening 22. Opening 22 will be used to view an LED which is part of the integrated circuit, as explained below.

Extending downwardly from the interior surface of top 20 is a circular side wall 24 which defines a cap recess 28 into which the integrated circuit 30 is received, as seen in FIG.

7. Cap 18 may be attached to part 14 using a bayonet-type closure mechanism, shown. Cap 18 is pressed into the recess 16 in part 14 and rotated relative to the part. Alternatively, the side wall 24 of the cap may be externally threaded such that it mates with an internally threaded surface formed in the wall of part 14 such that the cap is received in part 14 as it is rotated.

Figure 6:
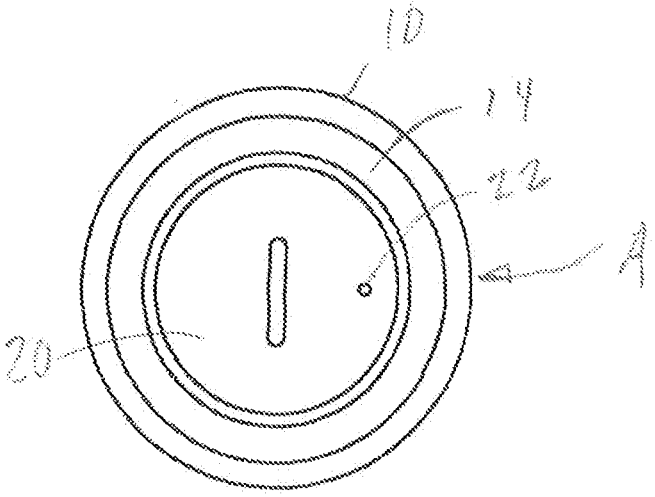
FIG. 6 is a plan view of the top of the umbrella handle with the cap.

As shown in FIG. 6, the exterior surface of top 20 of the cap is provided with a slot 32. The slot is adapted to receive the edge of a coin or the like such that the user can rotate the cap relative to the part 14 to attach or remove the cap from the umbrella to replace the battery.

Figure 7:
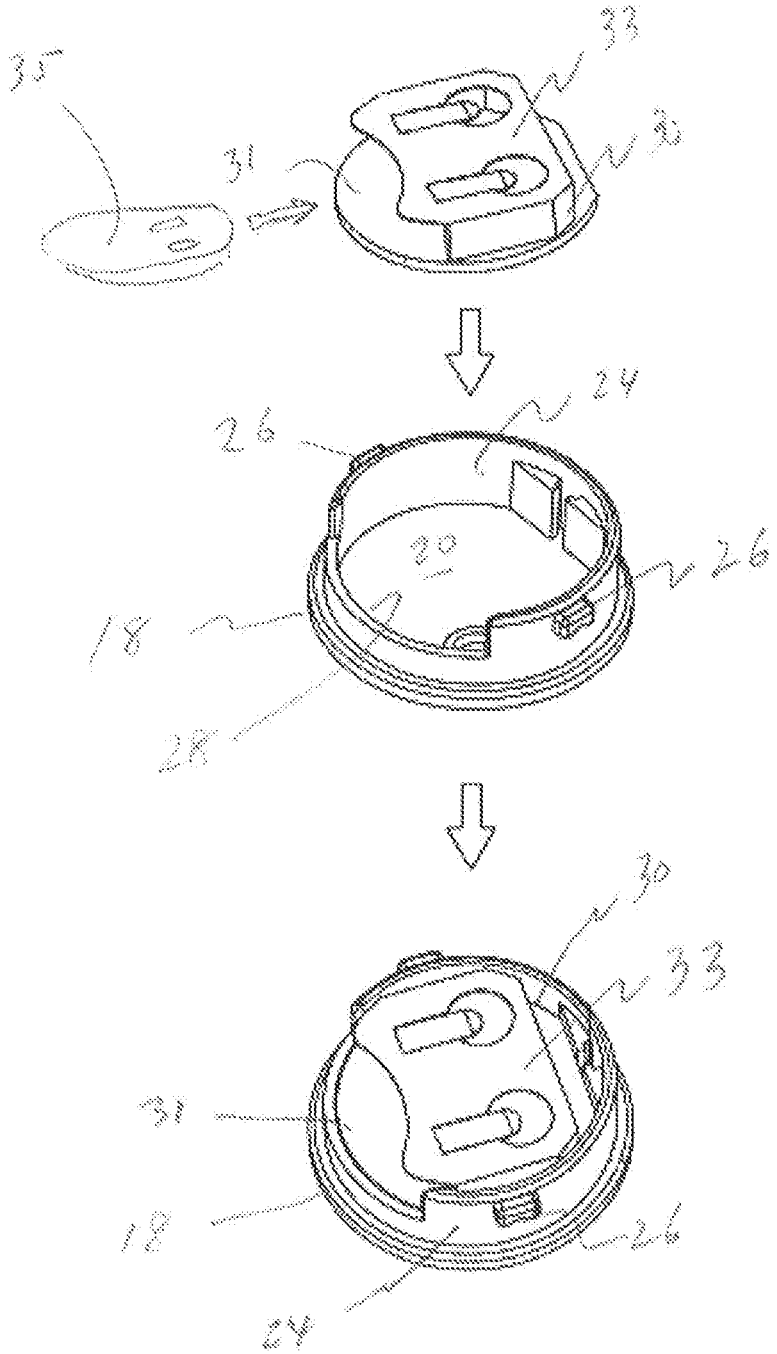
FIG. 7 is an exploded view showing how the integrated circuit is mounted in the cap.

Integrated circuit 30 includes a circuit board 31 and a plate 33 situated above the board. Board 31 and plate 33 form a recess designed to receive the battery 35 which powers the integrated circuit, as seen in FIG. 7.

FIG. 8 is a block diagram of the components of integrated circuit 30. The circuit includes a communication module 32 which is connected to receive the output of an accelerometer 34. Preferably, the accelerometer is capable of detecting motion with a threshold of greater than 0.50 G and less than 4 G in any axis for a minimum duration threshold of at least 25 milliseconds to no more than 10 seconds (10,000 milliseconds).

Module 32 is also connected to receive the output of a battery voltage output monitor 36. Module 32 has an input 38 which allows the module to be programmed and an output connected to energize an LED 40. LED 40 is aligned with opening 22 in cap 18 such that when cap 18 is mounted on the umbrella handle LED 40 is visible to the user when the end of the umbrella handle is observed.

Module 32 may be any commercially available component or set of electrical circuits, including a microprocessor, I/O controller, a memory, a clock, a power manager, and an antenna, provided as a unit or individually which are capable of being programmed or configured to periodically transmit a beacon signal over the range required for the present invention to function as described herein.

FIG. 9 is a basic flow chart of the operation of the module. Assuming that the umbrella is registered and wirelessly synced to the smartphone, when the module is turned on, LED 40 which is visible to the user through opening 22 in cap 18 will be energized to blink a number of times (for example, six times) to indicate that the circuit is powered.

Initially, the circuit operates in the low energy consumption mode. Upon receipt of an output signal from accelerometer 34 indicating that motion above a given level in at least one direction has been detected (movement of the umbrella), module 32 enters the active (high energy consumption) mode. LED 40 is energized to blink a certain number of times, for example, four times to indicate that the module has become active.

Upon entering the active mode, the module checks the battery voltage output monitor to determine whether battery 35 has sufficient output to power the integrated circuit. If it does not, a LOW-BATT flag is set and becomes a part of the beacon signal transmitted by the module to the smartphone.

The beacon signal is transmitted periodically, for example, every 100 ms to 5 seconds. Because the magnitude of the signal is set to a particular level, it will only be received by the smartphone when the smartphone is within the preset range of the umbrella. As long as the smartphone continues to receive the signal, the umbrella is within range and the smartphone does not generate an alert. Once the beacon signal is no longer received, the smartphone will issue an alert to tell the user that the umbrella is no longer in range.

The timing circuit in the module is energized each time the accelerator stops generating an output indicating that motion is detected. The timing circuit tracks how long it has been since motion has been detected by the accelerometer.

When the counter in the timing circuit reaches a preset level, the periodic transmission from the module is stopped and the module automatically returns to the inactive (low energy consumption) mode. This is important because umbrellas are often stored for extended periods of time between uses. If the module were to continue operating in the active (high energy consumption) mode for such periods, the battery would be quickly depleted, requiring frequent replacement of the battery even though the umbrella is not in use.

FIGS. 10 and 11 illustrate first and second preferred embodiments of the software application of the present invention. By way of background, the beacon and software application can operate in four states:

ADDED: New umbrellas can be added (synched) to the system. The beacon associated with each umbrella has a unique identification code (UUID). The beacon's UUID will be stored locally into the web based administrative system which controls the network of tethered umbrellas. Only those UUID beacons stored into the system will display on the smartphone home page of the system and trigger notifications. Furthermore, a Media Access Control (MAC) Address is embedded within the signal to assign a unique ID to each umbrella when read by the software application. A registration procedure is required to initially set up the umbrella beacon with the software application.

WITHIN RANGE: Once the umbrella is synched with the smartphone, if the smartphone is within the range of the umbrella, the software application running on the smartphone can receive the beacon signal from the umbrella and receive advertisements and other notifications from the system administrator. ALERT NOTIFICATIONS ON: When the beacon is within range of the smartphone, the smartphone may receive the beacon signal from the smartphone and the advertisements. A common notification that may be displayed is a weather report, particularly a weather forecast for rain. Thus, users of the system can be alerted in advance that rain is forecast so that they are reminded to take their umbrella with them.

ALERT NOTIFICATIONS OFF: Alert notifications can be turned off on the smartphone such that all notifications are disabled until the function is turned back on. The beacon will still be synced if within range, but the notifications will be suppressed.

A weather module may be provided within the software application that updates continually. The weather module will send a notification to the user's smartphone once the forecast for the day anticipates a certain level of precipitation.

If accelerometer 34 does not detect motion for more than a preset period, for example greater than 1 hour and less than 24 hours, the beacon signal transmission will be suppressed and the communications module 32 will enter the inactive (low energy consumption mode).

Once accelerometer 34 detects umbrella movement, the beacon signal will resume period transmission ("active mode") and continue to do so until the umbrella stops motion for a preset period. If the umbrella stops motion during the preset period and then resumes motion, the full preset period is restarted from when the motion resumed the inactive (low power consumption) mode.

When the circuit changes to the active (high energy consumption) mode (due to motion detection), LED 40 associated with the circuit will blink and then stop blinking until the next cycle.

The strength of the beacon transmitted by the circuit is sufficient for the software application to reliably detect range entry and range exit The accelerometer is configured to detect most normal motion (even slight movement to ensure the connection occurs and avoid the appearance of signal broadcast failure).

Each new umbrella must first be synced with the owner's smartphone software application. For the purposes of this disclosure, the term "syncing" will be used when the app has stored a beacon's UUID locally within the system.

Once a beacon has been synced and the software application enters near range, the beacon will display as "CONNECTED" on the home page and will thereafter auto-connect when the software application enters NEAR range and remains within INTERMEDIATE range. The status will change to "NOT CONNECTED" if the smart phone exits INTERMEDIATE range. Once the software application has exited INTERMEDIATE range, it will need to be in NEAR range again to once again be displayed as "connected" on home page (merely reentering INTERMEDIATE range alone after exit will not connect).

A battery output level indicator is provided on the smartphone. Each time motion is detected by the accelerometer, the battery voltage monitor in the integrated circuit is addressed. If the monitor detects that the battery is low, a "LOW-BATT" flag is set and transmitted to the smartphone to alert the user that the battery in the umbrella should be changed. It is also possible to indicate the amount of power remaining.

Multiple umbrellas can be connected to the app. The user must first sync each beacon initially in order for it to auto-connect. After the initial pairing, the beacon will thereafter auto-connect if in proximity and display on the home page.

Once synced, each umbrella beacon will display in the home page (unless deleted) as CONNECTED or NOT CONNECTED.

Once motion is detected by the accelerometer, the integrated circuit will start to transmit an advertisement signal as part of the beacon continuously. The advertisement signal will only cease if no motion is detected for a defined period.

Once synced, the software application will read the transmitted beacon signals if the smartphone comes within range. If the smartphone comes within the NEAR range (for example 2-3 ft.), a range entry notification will be sent. This notification will be sent whether the software application is in the background, or if the smartphone is in the inactive (low power consumption) mode (i.e. in the user's pocket).

If the umbrella is synced and the smartphone exits the beacon's Intermediate range, a range exit notification ("Umbrella is out of range") will be sent.

The notification will be sent whether the software application is running in the background, or if the smartphone is in the inactive (low energy consumption) mode (i.e. in the user's pocket).

As illustrated in FIG. 10, after the settings are checked, the software application runs in the foreground and begins tracking. The ranging evaluation is initiated to determine if the beacon signal from the integrated circuit of a wirelessly synced umbrella is transmitting, indicating that the umbrella is within the preset range. When a beacon signal is detected, a determination is made as to whether more than one beacon from more than one umbrella is being received. If more than one beacon is being received, one transmitting umbrella is selected, an entry notification is sent and the smartphone is set to the CONNECTED state. The smartphone remains in that state until the beacon signal is no longer detected. Once that occurs, an exit notification is sent and the smartphone waits until the beacon from the selected umbrella is again detected. If not, the smartphone is set to the NOT CONNECTED state.

This sequence is repeated in turn for each beacon signal detected. A requirement is set to detect a consecutive number of lost signal transmissions, which may be greater than 2 consecutive lost signal intervals but less than 20 consecutive lost signal intervals, before an exit notification is fired. If the sequence of lost signal intervals gets interrupted with a read signal transmission, the requirement to meet the defined consecutive number of lost signal transmissions is reset.

When the system is turned to OFF, the alarm and background logic will not run. When turned to ON, the smartphone will again start ranging for the beacon. If the beacon is transmitting and is within near range, the system will activate and entry notification will fire.

In the second preferred embodiment of the software application, a subroutine is used to periodically generate a signal which will allow the software application to run continuously in the background The second preferred embodiment of the software application is illustrated in FIG. 11. The second preferred embodiment is similar in most respects to the first preferred embodiment except that the second preferred embodiment is designed for use on smartphones which normally allow only limited software applications to run in the background simultaneously.

Custom logic is programmed into the software application of the present invention to keep the software application from going into suspended state allowing timely entry and exit notifications.

FIG. 11 illustrates a second preferred embodiment of the present invention. The second preferred embodiment includes a subroutine which causes the GPS module to generate an output and allows the software application to run in the background.

In the second preferred embodiment, a location update timer is employed. The location update starts each time that the entry notification is sent indicating that a beacon signal is being received. When the beacon signal is no longer detected, the exit notification is sent and the location timer is started and a location update signal from the GPS is generated allowing the software application to run in the background, just as if it was a location update.

The location update timer is set to a particular time interval, for example four hours. If a beacon signal is detected during the time that the location update timer is running, the location update timer is reset. If no beacon signal is detected before the location update timer expires, the software application is turned off, the location update ends, the smartphone is removed from tracking and a Termination notice is sent.

It is also possible to use the software application of the present invention with an integrated circuit associated with an umbrella but in which the integrated circuit is not located in the umbrella handle but instead in a compartment 42 as illustrated in FIG. 12.

As seen in FIG. 12, compartment 42 includes a body 44 which defines a recess within which the integrated circuit 30 may be situated. The compartment includes a flap 46. Flap 46 can be folded over a rib 48 of the umbrella and secured to the compartment body 44 by mating snaps or the like.

It will now be appreciated that the present invention is capable of detecting motion with a threshold of, for example greater than 0.50 G and less than 4 G in any axis, for a minimum duration threshold of at least 25 milliseconds to no more than 10 seconds (10,000 milliseconds). Once this threshold is met, transmission of the beacon signal will begin. The module will periodically transmit the beacon signal in intervals, for example greater than 100 ms and less than 5 seconds. Transmission will continue until the umbrella is motionless for a defined period, for example at least 1 continuous hour to less than 24 continuous hours. After the umbrella is motionless for that period, the module will return to the low energy consumption state. If umbrella motion is detected within the defined period, the module will reset the defined period timer and continue to transmit until it experiences no motion for the defined period.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims:

I claim:

1. An umbrella and a mobile communications device configured to wirelessly communicating with said umbrella, said umbrella comprising: an integrated circuit comprising a communications module adapted to transmit a wireless beacon signal indicating when said umbrella enters and leaves the vicinity of said communications device, said communications device running a software application which generates range entry and range exit notifications in response to said beacon signal alerting the user of said communications device when said umbrella enters and leaves the vicinity of said communications device, respectively, said communications device comprising a GPS module generating a GPS location signal and a periodic GPS location update, said communications device being configured to run only a limited number software applications in the background without suspension, wherein said communications device causes said GPS module to periodically generate the location update in response to the receipt of a range entrance notification such that said software application runs in the background on said communications device without going into a suspending state, thereby allowing said software application to timely process range entry and range exit notifications, said communications device further comprising a location update timer, said location update timer being set after the receipt of a range exit notification and configured to cause said GPS module to cease generating the location update after a given time interval, unless a range entry notification has been received, such that said software application is turned off.

2. The umbrella and mobile communications device of claim 1 wherein said module comprises a timing circuit and normally operating in an inactive mode, said integrated circuit further comprising an accelerometer adapted to detect movement of said umbrella and to generate an activation signal to said module when movement of said umbrella is detected causing said module to operate in an active mode and periodically transmit said beacon signal for a time period measured by said timing circuit, said software application detecting said beacon signal transmitted from said module when said umbrella and said communications device are within a given distance from each other and generating an range exit notification to the user of the communications device when said beacon signal is no longer being received, indicating that said umbrella and the communications device are no longer within said given distance.

3. The umbrella and device of claim 1 wherein said circuit further comprises a battery connected to power said integrated circuit, a voltage monitor for measuring the voltage output of said battery, and wherein said voltage monitor periodically measures the voltage output of said battery, and causes said module to include a low battery notification as part of said wireless beacon signal if the measured voltage output of the battery is below a given level.

4. The umbrella and device of claim 1 wherein said umbrella has a handle and wherein said handle comprises a recess within which said integrated circuit is situated.

5. The umbrella and device of claim 4 wherein said umbrella further comprises a cap within which said integrated circuit is retained and a part adapted to receive said cap secured within said handle recess.

6. The umbrella and device claim 1 wherein said umbrella comprising a handle with a recess defined in part by a bottom wall, a cap adapted to retain said integrated circuit and a part adapted to receive said cap, means for securing said part to said recess bottom wall and means for securing said cap to said part.

7. The umbrella and device of claim 6 wherein said part securing means comprises an internally threaded bore in said handle and an externally threaded shaft extending from said part.

8. The umbrella and device of claim 6 wherein said integrated circuit comprises an LED and wherein said cap comprises an opening aligned with said LED such that said LED can be observed through the cap when the cap is mounted on the handle.

9. The umbrella and device of claim 6 wherein said integrated circuit includes spaced plates defining a recess within which a battery may be retained.

10. The umbrella and device of claim 6 wherein said integrated circuit comprises a battery output voltage monitor.

* * * * *